US009468810B2

(12) United States Patent
Madson et al.

(10) Patent No.: US 9,468,810 B2
(45) **Date of Patent: *Oct. 18, 2016**

(54) DIMPLE PATTERNS FOR GOLF BALLS

(71) Applicant: Acushnet Company, Fairhaven, MA (US)

(72) Inventors: Michael R. Madson, Pawtucket, RI (US); Nicholas M. Nardacci, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/973,237

(22) Filed: Aug. 22, 2013

(65) Prior Publication Data

US 2013/0337940 A1 Dec. 19, 2013

Related U.S. Application Data

(63) Continuation of application No. 12/894,827, filed on Sep. 30, 2010, which is a continuation of application No. 12/262,464, filed on Oct. 31, 2008, now Pat. No. 8,029,388.

(51) Int. Cl.
*A63B 37/12* (2006.01)
*A63B 37/00* (2006.01)

(52) U.S. Cl.
CPC ..... *A63B 37/0006* (2013.01); *A63B 37/0004* (2013.01); *A63B 37/0007* (2013.01); *A63B 37/0018* (2013.01)

(58) Field of Classification Search
CPC ..... A63B 37/0006
USPC ..... 473/378–385
See application file for complete search history.

(56) References Cited

U.S. PATENT DOCUMENTS

| | | | | |
|---|---|---|---|---|
| 4,762,326 | A * | 8/1988 | Gobush | A63B 37/0004 473/380 |
| 4,998,733 | A | 3/1991 | Lee | |
| 5,046,742 | A | 9/1991 | Mackey | |
| 5,249,804 | A | 10/1993 | Sanchez | |
| 5,562,552 | A | 10/1996 | Thurman | |
| 6,123,534 | A | 9/2000 | Kasashima et al. | |
| 6,241,627 | B1 | 6/2001 | Kasashima et al. | |
| 6,682,442 | B2 * | 1/2004 | Winfield | A63B 37/0004 473/378 |
| 6,685,455 | B2 | 2/2004 | Ogg | |
| 7,048,652 | B2 * | 5/2006 | Sato et al. | 473/383 |
| 7,179,178 | B2 | 2/2007 | Veilleux | |
| 7,422,529 | B2 | 9/2008 | Aoyama et al. | |
| 8,029,388 | B2 | 10/2011 | Nardacci et al. | |
| 2006/0264271 | A1 * | 11/2006 | Veilleux et al. | 473/378 |

(Continued)

*Primary Examiner* — Raeann Gorden
(74) *Attorney, Agent, or Firm* — Kristin D. Wheeler

(57) ABSTRACT

The present invention provides a method for arranging dimples on a golf ball surface in which the dimples are arranged in a pattern derived from at least one irregular domain generated from a regular or non-regular polyhedron. The method includes choosing control points of a polyhedron, generating an irregular domain based on those control points, packing the irregular domain with dimples, and tessellating the irregular domain to cover the surface of the golf ball. The control points include the center of a polyhedral face, a vertex of the polyhedron, a midpoint or other point on an edge of the polyhedron and others. The method ensures that the symmetry of the underlying polyhedron is preserved while minimizing or eliminating great circles due to parting lines.

7 Claims, 12 Drawing Sheets

(56) References Cited

U.S. PATENT DOCUMENTS

| | | | |
|---|---|---|---|
| 2010/0113187 | A1 | 5/2010 | Nardacci et al. |
| 2011/0165968 | A1 | 7/2011 | Madson et al. |
| 2012/0088607 | A1 | 4/2012 | Madson et al. |
| 2013/0065709 | A1 | 3/2013 | Madson et al. |
| 2013/0072325 | A1 | 3/2013 | Madson et al. |

* cited by examiner

DIMPLE PATTERNS FOR GOLF BALLS

CROSS-REFERENCE TO RELATED APPLICATIONS

This application is a continuation of U.S. patent application Ser. No. 12/894,827, filed Sep. 30, 2010, which is a continuation-in-part of U.S. patent application Ser. No. 12/262,464, filed Oct. 31, 2008, now issued as U.S. Pat. No. 8,029,388, the entire disclosures of which are hereby incorporated herein by reference.

FIELD OF THE INVENTION

This invention relates to golf balls, particularly to golf balls possessing uniquely packed dimple patterns. More particularly, the invention relates to methods of arranging dimples on a golf ball by generating irregular domains based on polyhedrons, packing the irregular domains with dimples, and tessellating the domains onto the surface of the golf ball.

BACKGROUND OF THE INVENTION

Historically, dimple patterns for golf balls have had a variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, pattern development is a secondary design step that is used to achieve the appropriate aerodynamic behavior, thereby tailoring ball flight characteristics and performance.

Aerodynamic forces generated by a ball in flight are a result of its velocity and spin. These forces can be represented by a lift force and a drag force. Lift force is perpendicular to the direction of flight and is a result of air velocity differences above and below the rotating ball. This phenomenon is attributed to Magnus, who described it in 1853 after studying the aerodynamic forces on spinning spheres and cylinders, and is described by Bernoulli's Equation, a simplification of the first law of thermodynamics. Bernoulli's equation relates pressure and velocity where pressure is inversely proportional to the square of velocity. The velocity differential, due to faster moving air on top and slower moving air on the bottom, results in lower air pressure on top and an upward directed force on the ball.

Drag is opposite in sense to the direction of flight and orthogonal to lift. The drag force on a ball is attributed to parasitic drag forces, which consist of pressure drag and viscous or skin friction drag. A sphere is a bluff body, which is an inefficient aerodynamic shape. As a result, the accelerating flow field around the ball causes a large pressure differential with high-pressure forward and low-pressure behind the ball. The low pressure area behind the ball is also known as the wake. In order to minimize pressure drag, dimples provide a means to energize the flow field and delay the separation of flow, or reduce the wake region behind the ball. Skin friction is a viscous effect residing close to the surface of the ball within the boundary layer.

The industry has seen many efforts to maximize the aerodynamic efficiency of golf balls, through dimple disturbance and other methods, though they are closely controlled by golf's national governing body, the United States Golf Association (U.S.G.A.). One U.S.G.A. requirement is that golf balls have aerodynamic symmetry. Aerodynamic symmetry allows the ball to fly with a very small amount of variation no matter how the golf ball is placed on the tee or ground. Preferably, dimples cover the maximum surface area of the golf ball without detrimentally affecting the aerodynamic symmetry of the golf ball.

In attempts to improve aerodynamic symmetry, many dimple patterns are based on geometric shapes. These may include circles, hexagons, triangles, and the like. Other dimple patterns are based in general on the five Platonic Solids including icosahedron, dodecahedron, octahedron, cube, or tetrahedron. Yet other dimple patterns are based on the thirteen Archimedian Solids, such as the small icosidodecahedron, rhomicosidodecahedron, small rhombicuboctahedron, snub cube, snub dodecahedron, or truncated icosahedron. Furthermore, other dimple patterns are based on hexagonal dipyramids. Because the number of symmetric solid plane systems is limited, it is difficult to devise new symmetric patterns. Moreover, dimple patterns based some of these geometric shapes result in less than optimal surface coverage and other disadvantageous dimple arrangements. Therefore, dimple properties such as number, shape, size, volume, and arrangement are often manipulated in an attempt to generate a golf ball that has improved aerodynamic properties.

U.S. Pat. No. 5,562,552 to Thurman discloses a golf ball with an icosahedral dimple pattern, wherein each triangular face of the icosahedron is split by a three straight lines which each bisect a corner of the face to form 3 triangular faces for each icosahedral face, wherein the dimples are arranged consistently on the icosahedral faces.

U.S. Pat. No. 5,046,742 to Mackey discloses a golf ball with dimples packed into a 32-sided polyhedron composed of hexagons and pentagons, wherein the dimple packing is the same in each hexagon and in each pentagon.

U.S. Pat. No. 4,998,733 to Lee discloses a golf ball formed of ten "spherical" hexagons each split into six equilateral triangles, wherein each triangle is split by a bisecting line extending between a vertex of the triangle and the midpoint of the side opposite the vertex, and the bisecting lines are oriented to achieve improved symmetry.

U.S. Pat. No. 6,682,442 to Winfield discloses the use of polygons as packing elements for dimples to introduce predictable variance into the dimple pattern. The polygons extend from the poles of the ball to a parting line. Any space not filled with dimples from the polygons is filled with other dimples.

SUMMARY OF THE INVENTION

In one embodiment, the present invention is directed to a golf ball having an outer surface comprising a parting line and a plurality of dimples. The dimples are arranged in multiple copies of one or more irregular domain(s) covering the outer surface in a uniform pattern. The irregular domain(s) are defined by non-straight segments, and one of the non-straight segments of each of the multiple copies of the irregular domain(s) forms a portion of the parting line.

In another embodiment, the present invention is directed to a method for arranging a plurality of dimples on a golf ball surface. The method comprises generating a first and a second irregular domain based on a tetrahedron using a midpoint to midpoint method, mapping the first and second irregular domains onto a sphere, packing the first and second irregular domains with dimples, and tessellating the first and second domains to cover the sphere in a uniform pattern. The midpoint to midpoint method comprises providing a single face of the tetrahedron, the face comprising a first edge connected to a second edge at a vertex; connecting the midpoint of the first edge with the midpoint of the second edge with a non-straight segment; rotating copies of the segment about the center of the face such that the segment and the copies fully surround the center and form the first irregular domain bounded by the segment and the copies; and rotating subsequent copies of the segment about the vertex such that the segment and the subsequent copies fully surround the vertex and form the second irregular domain bounded by the segment and the subsequent copies.

In yet another embodiment, the present invention is directed to a golf ball having an outer surface comprising a plurality of dimples, wherein the dimples are arranged by a method comprising generating a first and a second irregular domain based on a tetrahedron using a midpoint to midpoint method, mapping the first and second irregular domains onto a sphere, packing the first and second irregular domains with dimples, and tessellating the first and second domains to cover the sphere in a uniform pattern.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

The present invention provides a method for arranging dimples on a golf ball surface in a pattern derived from at least one irregular domain generated from a regular or non-regular polyhedron. The method includes choosing control points of a polyhedron, connecting the control points with a non-straight sketch line, patterning the sketch line in a first manner to generate an irregular domain, optionally patterning the sketch line in a second manner to create an additional irregular domain, packing the irregular domain(s) with dimples, and tessellating the irregular domain(s) to cover the surface of the golf ball in a uniform pattern. The control points include the center of a polyhedral face, a vertex of the polyhedron, a midpoint or other point on an edge of the polyhedron, and others. The method ensures that the symmetry of the underlying polyhedron is preserved while minimizing or eliminating great circles due to parting lines from the molding process.

Figure 1A:
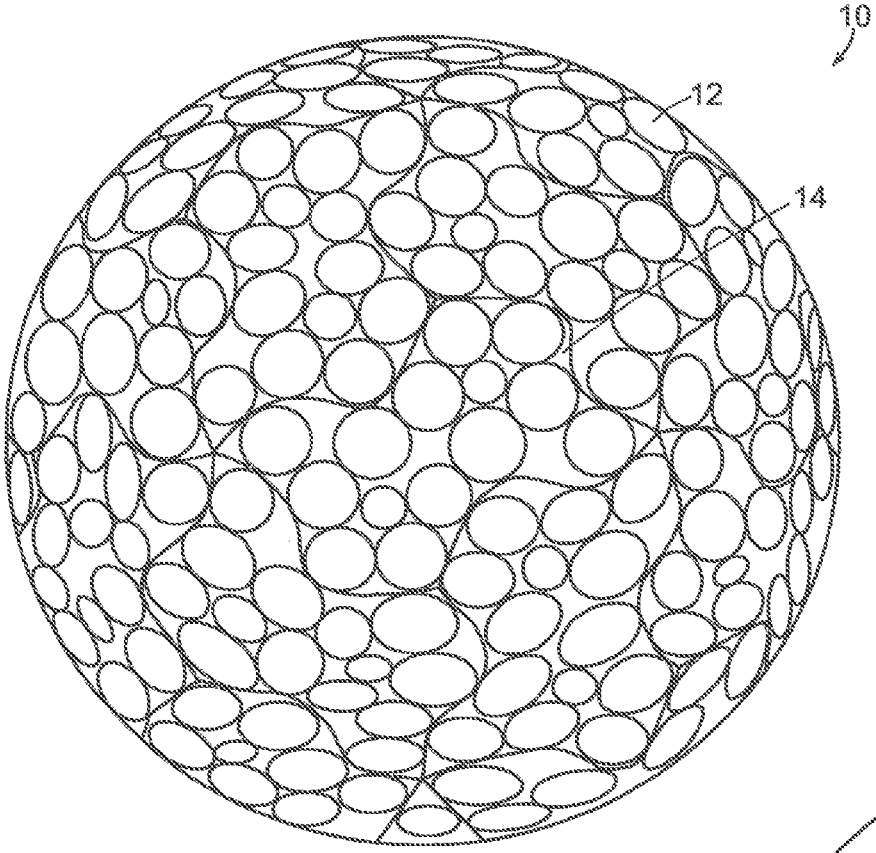
FIG. 1A illustrates a golf ball having dimples arranged by a method of the present invention.
Figure 1D:
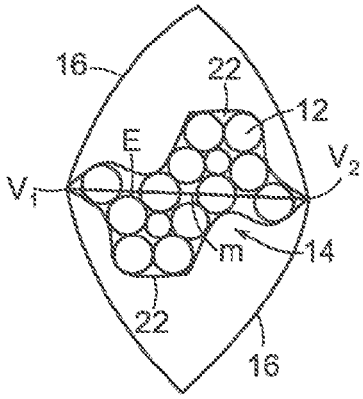
FIG. 1D illustrates a domain formed by a methods of the present invention packed with dimples and formed from two elements of FIG. 1C.

In a particular embodiment, illustrated in FIG. 1A, the present invention comprises a golf ball 10 comprising dimples 12. Dimples 12 are arranged by packing irregular domains 14 with dimples, as seen best in FIG. 1D. Irregular domains 14 are created in such a way that, when tessellated on the surface of golf ball 10, they impart greater orders of symmetry to the surface than prior art balls. The irregular shape of domains 14 additionally minimize the appearance and effect of the golf ball parting line from the molding process, and allows greater flexibility in arranging dimples than would be available with regularly shaped domains.

For purposes of the present invention, the term "irregular domains" refers to domains wherein at least one, and preferably all, of the segments defining the borders of the domain is not a straight line.

The irregular domains can be defined through the use of any one of the exemplary methods described herein. Each method produces one or more unique domains based on circumscribing a sphere with the vertices of a regular polyhedron. The vertices of the circumscribed sphere based on the vertices of the corresponding polyhedron with origin (0,0,0) are defined below in Table 1.

TABLE 1

Vertices of Circumscribed Sphere based on Corresponding Polyhedron Vertices

| Type of Polyhedron | Vertices |
|---|---|
| Tetrahedron | (+1, +1, +1); (−1, −1, +1); (−1, +1, −1); (+1, −1, −1) |
| Cube | (±1, ±1, ±1) |
| Octahedron | (±1, 0, 0); (0, ±1, 0); (0, 0, ±1) |
| Dodecahedron | (±1, ±1, ±1); (0, ±1/ϕ, ±ϕ); (±1/ϕ, ±ϕ, 0); (±ϕ, 0, ±1/ϕ)* |
| Icosahedron | (0, ±1, ±ϕ); (±1, ±ϕ, 0); (±ϕ, 0, ±1)* |

*$\phi = (1 + \sqrt{5})/2$

Figure 2:
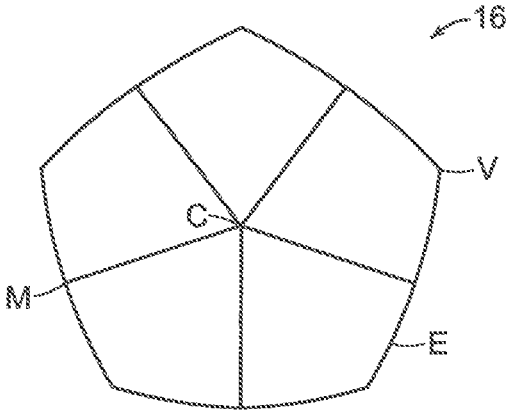
FIG. 2 illustrates a single face of a polyhedron having control points thereon.

Each method has a unique set of rules which are followed for the domain to be symmetrically patterned on the surface of the golf ball. Each method is defined by the combination of at least two control points. These control points, which are taken from one or more faces of a regular or non-regular polyhedron, consist of at least three different types: the center C of a polyhedron face; a vertex V of a face of a regular polyhedron; and the midpoint M of an edge of a face of the polyhedron. FIG. 2 shows an exemplary face 16 of a polyhedron (a regular dodecahedron in this case) and one of each a center C, a midpoint M, a vertex V, and an edge E on face 16. The two control points C, M, or V may be of the same or different types. Accordingly, six types of methods for use with regular polyhedrons are defined as follows:

1. Center to midpoint (C→M);
2. Center to center (C→C);
3. Center to vertex (C→V);
4. Midpoint to midpoint (M→M);
5. Midpoint to Vertex (M→V); and
6. Vertex to Vertex (V→V).

While each method differs in its particulars, they all follow the same basic scheme. First, a non-linear sketch line is drawn connecting the two control points. This sketch line may have any shape, including, but not limited, to an arc, a spline, two or more straight or arcuate lines or curves, or a combination thereof. Second, the sketch line is patterned in a method specific manner to create a domain, as discussed below. Third, when necessary, the sketch line is patterned in a second fashion to create a second domain.

While the basic scheme is consistent for each of the six methods, each method preferably follows different steps in order to generate the domains from a sketch line between the two control points, as described below with reference to each of the methods individually.

The Center to Vertex Method

Figure 1B:
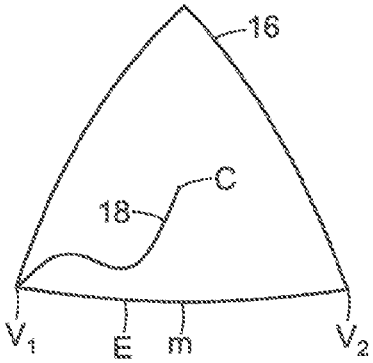
FIG. 1B illustrates a polyhedron face.
Figure 1C:
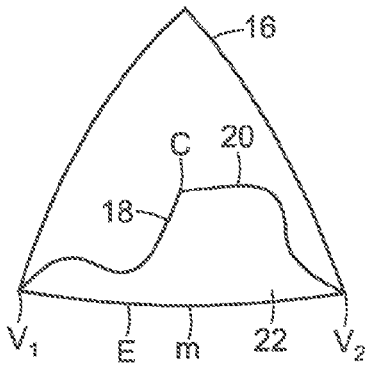
FIG. 1C illustrates an element of the present invention in the polyhedron face of FIG. 1B.

Referring again to FIGS. 1A-1D, the center to vertex method yields one domain that tessellates to cover the surface of golf ball 10. The domain is defined as follows:

1. A regular polyhedron is chosen (FIGS. 1A-1D use an icosahedron);
2. A single face 16 of the regular polyhedron is chosen, as shown in FIG. 1B;
3. Center C of face 16, and a first vertex $V_1$ of face 16 are connected with any non-linear sketch line, hereinafter referred to as a segment 18;
4. A copy 20 of segment 18 is rotated about center C, such that copy 20 connects center C with vertex $V_2$ adjacent to vertex $V_1$. The two segments 18 and 20 and the edge E connecting vertices $V_1$ and $V_2$ define an element 22, as shown best in FIG. 1C; and
5. Element 22 is rotated about midpoint M of edge E to create a domain 14, as shown best in FIG. 1D.

When domain 14 is tessellated to cover the surface of golf ball 10, as shown in FIG. 1A, a different number of total domains 14 will result depending on the regular polyhedron chosen as the basis for control points C and $V_1$. The number of domains 14 used to cover the surface of golf ball 10 is equal to the number of faces $P_F$ of the polyhedron chosen times the number of edges $P_E$ per face of the polyhedron divided by 2, as shown below in Table 2.

TABLE 2

Domains Resulting From Use of Specific Polyhedra When Using the Center to Vertex Method

| Type of Polyhedron | Number of Faces, $P_F$ | Number of Edges, $P_E$ | Number of Domains 14 |
|---|---|---|---|
| Tetrahedron | 4 | 3 | 6 |
| Cube | 6 | 4 | 12 |
| Octahedron | 8 | 3 | 12 |
| Dodecahedron | 12 | 5 | 30 |
| Icosahedron | 20 | 3 | 30 |

The Center to Midpoint Method

Figure 3C:
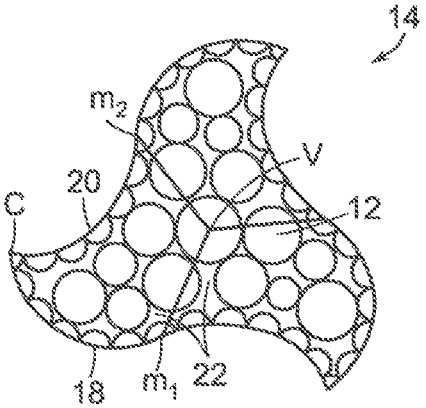
FIG. 3C illustrates a domain of the present invention packed with dimples formed from elements of FIG. 3B.
Figure 3A:
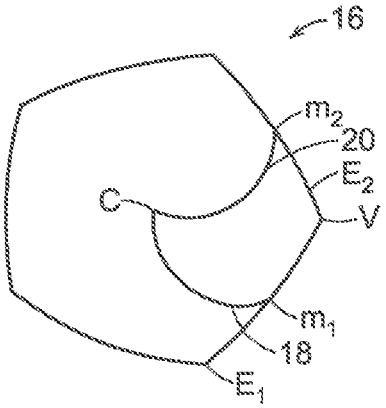
FIG. 3A illustrates a polyhedron face.

Referring to FIGS. 3A-3D, the center to midpoint method yields a single irregular domain that can be tessellated to cover the surface of golf ball 10. The domain is defined as follows:

1. A regular polyhedron is chosen (FIGS. 3A-3D use a dodecahedron);
2. A single face 16 of the regular polyhedron is chosen, as shown in FIG. 3A;
3. Center C of face 16, and midpoint $M_1$ of a first edge $E_1$ of face 16 are connected with a segment 18;
4. A copy 20 of segment 18 is rotated about center C, such that copy 20 connects center C with a midpoint $M_2$ of a second edge $E_2$ adjacent to first edge $E_1$. The two segments 16 and 18 and the portions of edge $E_1$ and edge $E_2$ between midpoints $M_1$ and $M_2$ define an element 22; and
5. Element 22 is patterned about vertex V of face 16 which is contained in element 22 and connects edges $E_1$ and $E_2$ to create a domain 14.

Figure 3D:
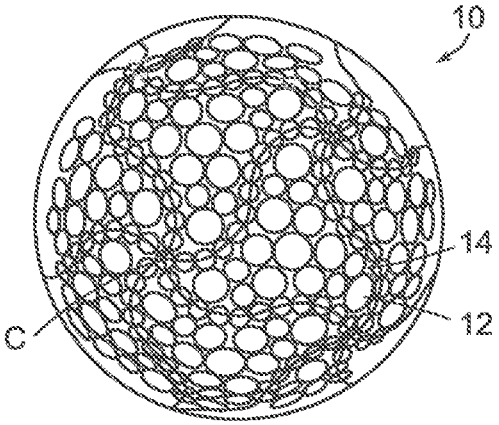
FIG. 3D illustrates a golf ball formed by a method of the present invention formed of the domain of FIG. 3C.
Figure 3B:
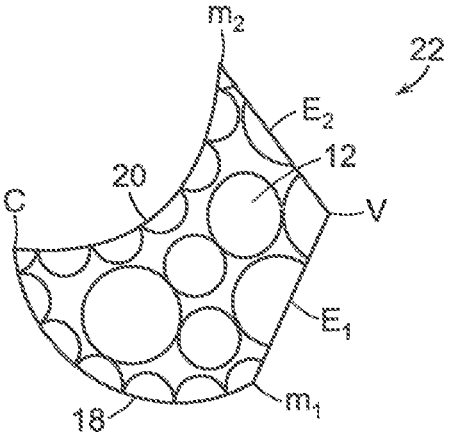
FIG. 3B illustrates an element of the present invention packed with dimples.

When domain 14 is tessellated around a golf ball 10 to cover the surface of golf ball 10, as shown in FIG. 3D, a different number of total domains 14 will result depending on the regular polyhedron chosen as the basis for control points C and $M_1$. The number of domains 14 used to cover the surface of golf ball 10 is equal to the number of vertices $P_y$ of the chosen polyhedron, as shown below in Table 3.

TABLE 3

Domains Resulting From Use of Specific Polyhedra When Using the Center to Midpoint Method

| Type of Polyhedron | Number of Vertices, $P_V$ | Number of Domains 14 |
|---|---|---|
| Tetrahedron | 4 | 4 |
| Cube | 8 | 8 |
| Octahedron | 6 | 6 |
| Dodecahedron | 20 | 20 |
| Icosahedron | 12 | 12 |

The Center to Center Method

Figure 4A:
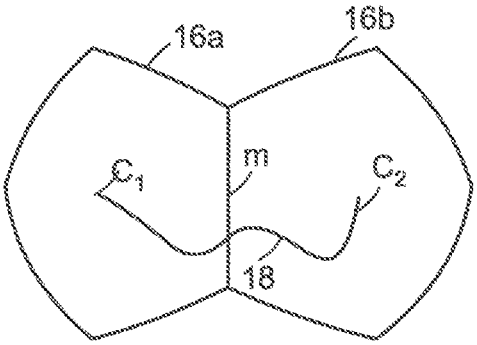
FIG. 4A illustrates two polyhedron faces.
Figure 4C:
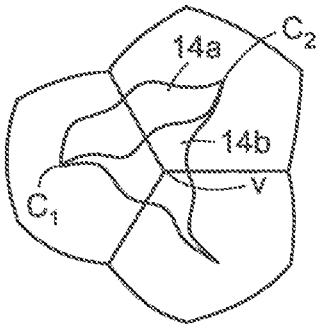
FIG. 4C illustrates a first domain and a second domain of the present invention in three polyhedron faces.
Figure 4B:
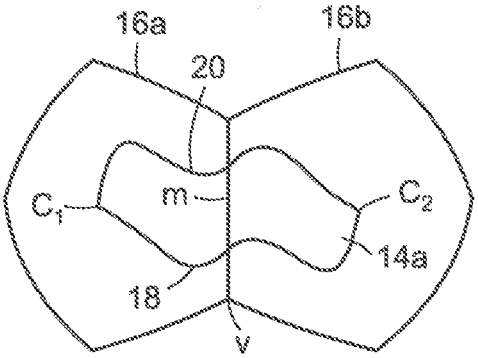
FIG. 4B illustrates a first domain of the present invention in the two polyhedron faces of FIG. 4A.

Referring to FIGS. 4A-4D, the center to center method yields two domains that can be tessellated to cover the surface of golf ball 10. The domains are defined as follows:

1. A regular polyhedron is chosen (FIGS. 4A-4D use a dodecahedron);
2. Two adjacent faces 16*a* and 16*b* of the regular polyhedron are chosen, as shown in FIG. 4A;
3. Center $C_1$ of face 16*a*, and center $C_2$ of face 16*b* are connected with a segment 18;
4. A copy 20 of segment 18 is rotated 180 degrees about the midpoint M between centers $C_1$ and $C_2$, such that copy 20 also connects center $C_1$ with center $C_2$, as shown in FIG. 4B. The two segments 16 and 18 define a first domain 14*a*; and
5. Segment 18 is rotated equally about vertex V to define a second domain 14*b*, as shown in FIG. 4C.

Figure 4D:
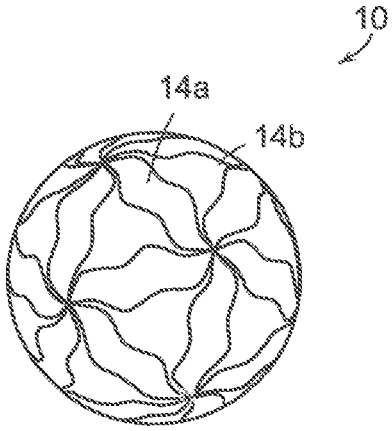
FIG. 4D illustrates a golf ball formed by a method of the present invention formed of the domains of FIG. 4C.

When first domain 14*a* and second domain 14*b* are tessellated to cover the surface of golf ball 10, as shown in FIG. 4D, a different number of total domains 14*a* and 14*b* will result depending on the regular polyhedron chosen as the basis for control points $C_1$ and $C_2$. The number of first and second domains 14*a* and 14*b* used to cover the surface of golf ball 10 is $P_F*P_E/2$ for first domain 14*a* and $P_V$ for second domain 14*b*, as shown below in Table 4.

TABLE 4

Domains Resulting From Use of Specific Polyhedra When Using the Center to Center Method

| Type of Polyhedron | Number of Vertices, $P_V$ | Number of First Domains 14a | Number of Faces, $P_F$ | Number of Edges, $P_E$ | Number of Second Domains 14b |
|---|---|---|---|---|---|
| Tetrahedron | 4 | 6 | 4 | 3 | 4 |
| Cube | 8 | 12 | 6 | 4 | 8 |
| Octahedron | 6 | 9 | 8 | 3 | 6 |
| Dodecahedron | 20 | 30 | 12 | 5 | 20 |
| Icosahedron | 12 | 18 | 20 | 3 | 12 |

The Midpoint to Midpoint Method

Figure 5A:
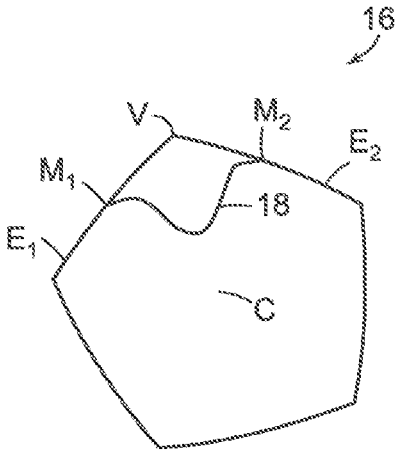
FIG. 5A illustrates a polyhedron face.
Figure 5C:
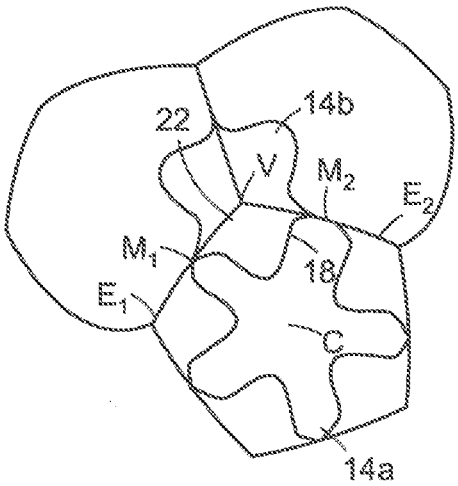
FIG. 5C illustrates a first domain and a second domain of the present invention in three polyhedron faces.
Figure 5B:
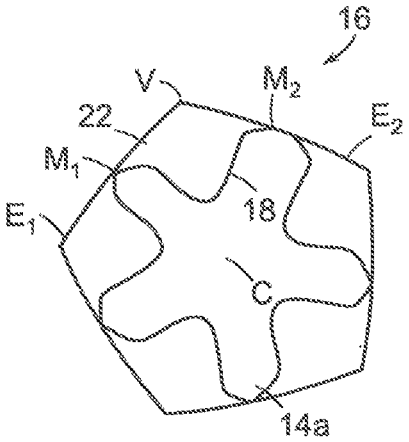
FIG. 5B illustrates a first domain of the present invention in a polyhedron face.
Figure 11A:
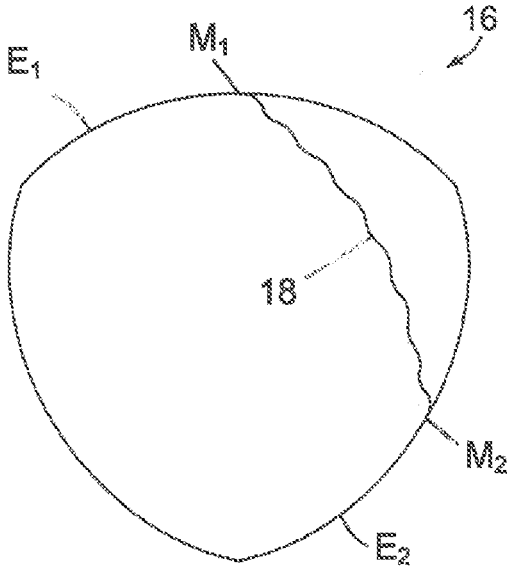
FIG. 11A illustrates a tetrahedron face projected on a sphere.
Figure 11B:
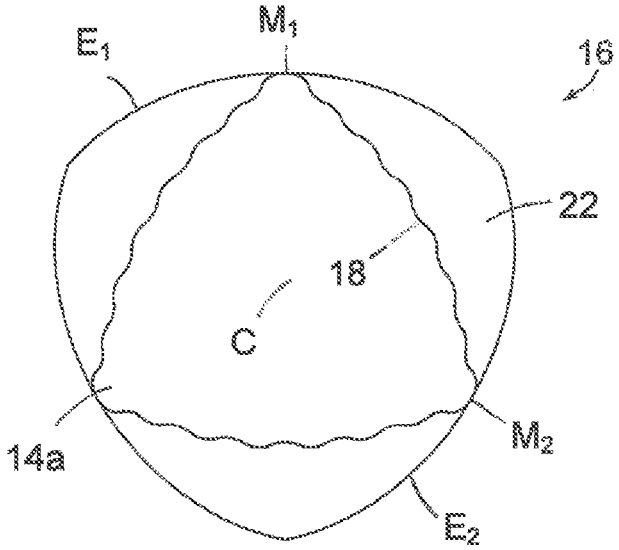
FIG. 11B illustrates a first domain of the present invention in the tetrahedron face of FIG. 11A.
Figure 11C:
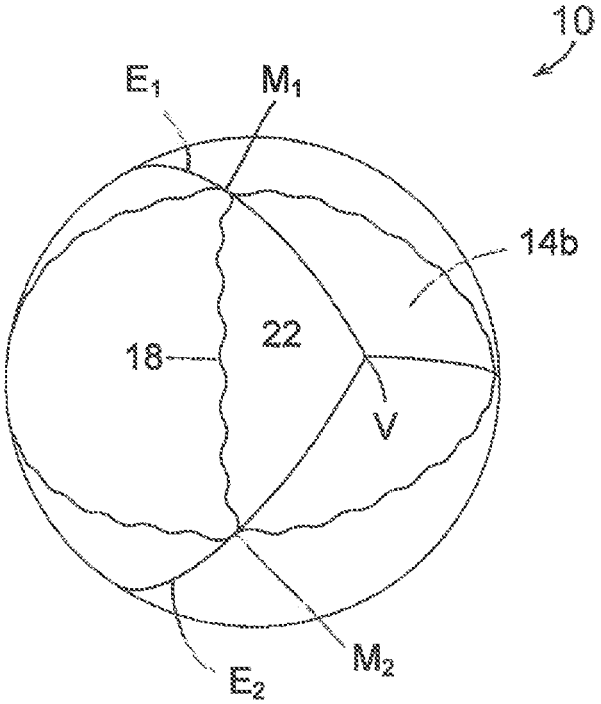
FIG. 11C illustrates a first domain and a second domain of the present invention projected on a sphere.

Referring to FIGS. 5A-5D and 11A-11G, the midpoint to midpoint method yields two domains that tessellate to cover the surface of golf ball 10. The domains are defined as follows:

1. A regular polyhedron is chosen (FIGS. 5A-5D use a dodecahedron, FIGS. 11A-11G use a tetrahedron);
2. A single face 16 of the regular polyhedron is projected onto a sphere, as shown in FIGS. 5A and 11A;
3. The midpoint $M_1$ of a first edge $E_1$ of face 16, and the midpoint $M_2$ of a second edge $E_2$ adjacent to first edge $E_1$ are connected with a segment 18, as shown in FIGS. 5A and 11A;
4. Segment 18 is patterned around center C of face 16, at an angle of rotation equal to $360/P_E$, to form a first domain 14*a*, as shown in FIGS. 5B and 11B;
5. Segment 18, along with the portions of first edge $E_1$ and second edge $E_2$ between midpoints $M_1$ and $M_2$, define an element 22, as shown in FIGS. 5B and 11B; and
6. Element 22 is patterned about the vertex V which connects edges $E_1$ and $E_2$ to create a second domain 14*b*, as shown in FIGS. 5C and 11C. The number of segments in the pattern that forms the second domain is equal to $P_F*P_F/P_V$.

Figure 5D:
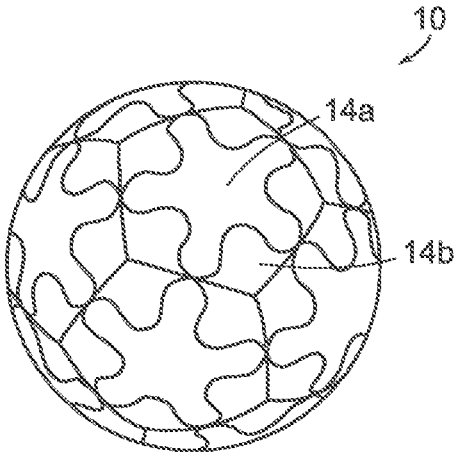
FIG. 5D illustrates a golf ball formed using a method of the present invention formed of the domains of FIG. 5C.
Figure 11D:
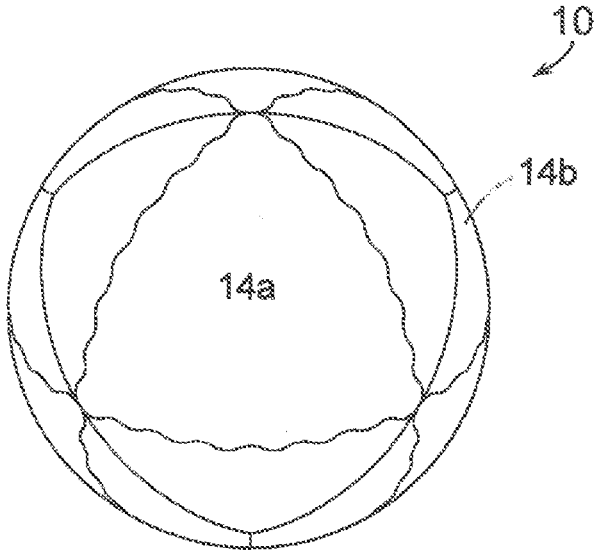
FIG. 11D illustrates the domains of FIG. 11C tessellated to cover the surface of a sphere.

When first domain 14*a* and second domain 14*b* are tessellated to cover the surface of golf ball 10, as shown in FIGS. 5D and 11D, a different number of total domains 14*a* and 14*b* will result depending on the regular polyhedron chosen as the basis for control points $M_1$ and $M_2$. The number of first and second domains 14*a* and 14*b* used to cover the surface of golf ball 10 is $P_F$ for first domain 14*a* and $P_y$ for second domain 14*b*, as shown below in Table 5.

In a particular aspect of the embodiment shown in FIGS. 11A-11G, segment 18 forms a portion of a parting line of golf ball 10. Thus, segment 18, along with each copy thereof that is produced by steps 4 and 6 above, produce the real and two false parting lines of the ball when the domains are tessellated to cover the ball's surface.

TABLE 5

Domains Resulting From Use of Specific Polyhedra When Using the Midpoint to Midpoint Method

| Type of Polyhedron | Number of Faces, $P_F$ | Number of First Domains 14a | Number of Vertices, $P_V$ | Number of Second Domains 14b |
|---|---|---|---|---|
| Tetrahedron | 4 | 4 | 4 | 4 |
| Cube | 6 | 6 | 8 | 8 |
| Octahedron | 8 | 8 | 6 | 6 |
| Dodecahedron | 12 | 12 | 20 | 20 |
| Icosahedron | 20 | 20 | 12 | 12 |

The Midpoint to Vertex Method

Figure 6A:
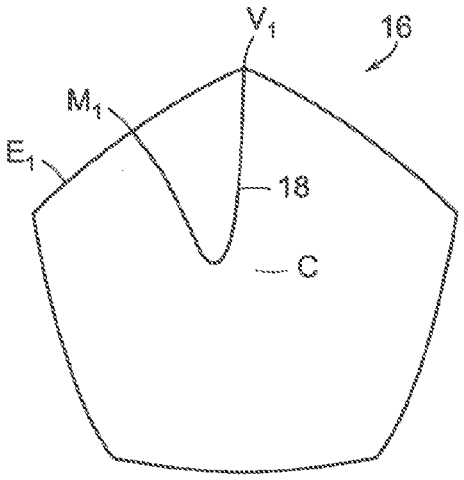
FIG. 6A illustrates a polyhedron face.
Figure 6C:
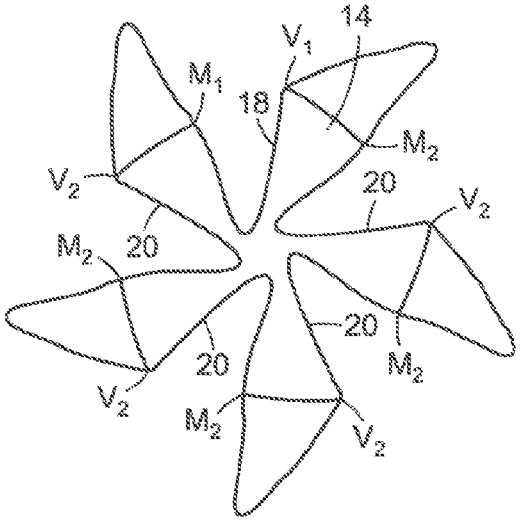
FIG. 6C illustrates a domain formed by the methods of the present invention.
Figure 6B:
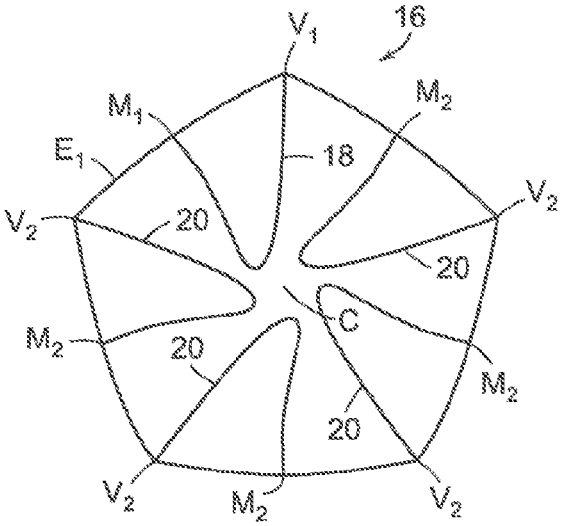
FIG. 6B illustrates a portion of a domain of the present invention in the polyhedron face of FIG. 6A.

Referring to FIGS. 6A-6D, the midpoint to vertex method yields one domain that tessellates to cover the surface of golf ball 10. The domain is defined as follows:

1. A regular polyhedron is chosen (FIGS. 6A-6D use a dodecahedron);
2. A single face 16 of the regular polyhedron is chosen, as shown in FIG. 6A;
3. A midpoint $M_1$ of edge $E_1$ of face 16 and a vertex $V_1$ on edge $E_1$ are connected with a segment 18;
4. Copies 20 of segment 18 is patterned about center C of face 16, one for each midpoint $M_2$ and vertex $V_2$ of face 16, to define a portion of domain 14, as shown in FIG. 6B; and
5. Segment 18 and copies 20 are then each rotated 180 degrees about their respective midpoints to complete domain 14, as shown in FIG. 6C.

Figure 6D:
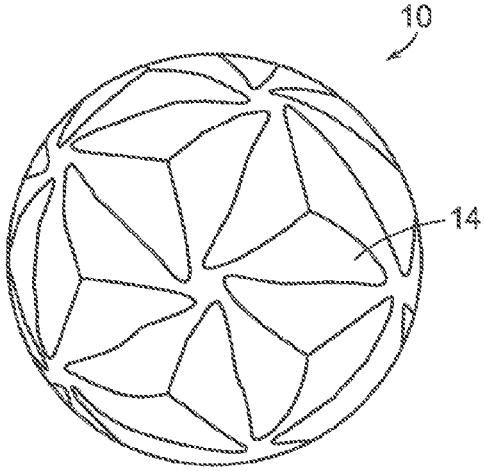
FIG. 6D illustrates a golf ball formed using the methods of the present invention formed of domains of FIG. 6C.

When domain 14 is tessellated to cover the surface of golf ball 10, as shown in FIG. 6D, a different number of total domains 14 will result depending on the regular polyhedron chosen as the basis for control points $M_1$ and $V_1$. The number of domains 14 used to cover the surface of golf ball 10 is $P_F$, as shown in Table 6.

TABLE 6

Domains Resulting From Use of Specific Polyhedra When Using the Midpoint to Vertex Method

| Type of Polyhedron | Number of Faces, $P_F$ | Number of Domains 14 |
|---|---|---|
| Tetrahedron | 4 | 4 |
| Cube | 6 | 6 |

TABLE 6-continued

| Domains Resulting From Use of Specific Polyhedra When Using the Midpoint to Vertex Method | | |
|---|---|---|
| Type of Polyhedron | Number of Faces, $P_F$ | Number of Domains 14 |
| Octahedron | 8 | 8 |
| Dodecahedron | 12 | 12 |
| Icosahedron | 20 | 20 |

The Vertex to Vertex Method

Figure 7A:
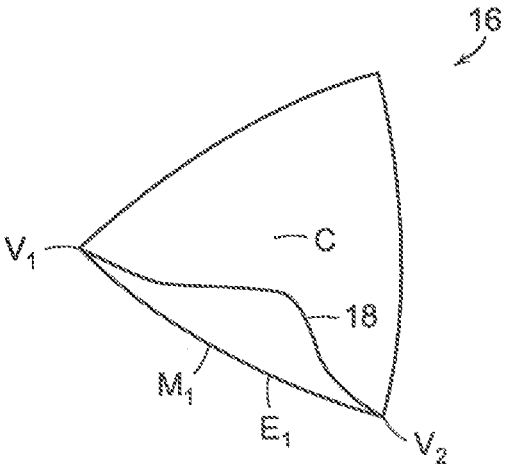
FIG. 7A illustrates a polyhedron face.
Figure 7C:
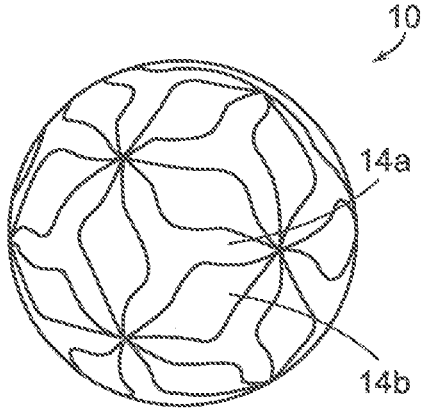
FIG. 7C illustrates a golf ball formed by a method of the present invention.
Figure 7B:
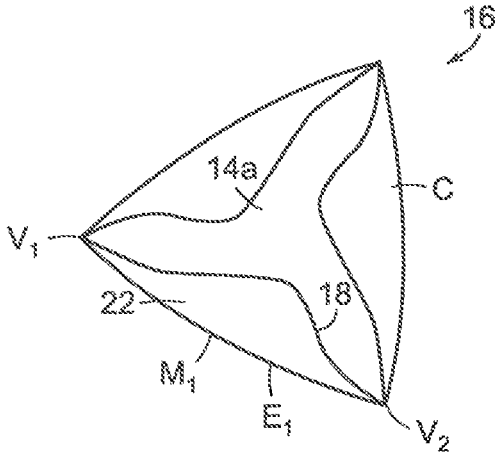
FIG. 7B illustrates a domain of the present invention in the polyhedron face of FIG. 7A.

Referring to FIGS. 7A-7C, the vertex to vertex method yields two domains that tessellate to cover the surface of golf ball 10. The domains are defined as follows:

1. A regular polyhedron is chosen (FIGS. 7A-7C use an icosahedron);
2. A single face 16 of the regular polyhedron is chosen, as shown in FIG. 7A;
3. A first vertex $V_1$ face 16, and a second vertex $V_2$ adjacent to first vertex $V_1$ are connected with a segment 18;
4. Segment 18 is patterned around center C of face 16 to form a first domain 14*a*, as shown in FIG. 7B;
5. Segment 18, along with edge $E_1$ between vertices $V_1$ and $V_2$, defines an element 22; and
6. Element 22 is rotated around midpoint $M_1$ of edge $E_1$ to create a second domain 14*b*.

When first domain 14*a* and second domain 14*b* are tessellated to cover the surface of golf ball 10, as shown in FIG. 7C, a different number of total domains 14*a* and 14*b* will result depending on the regular polyhedron chosen as the basis for control points $V_1$ and $V_2$. The number of first and second domains 14*a* and 14*b* used to cover the surface of golf ball 10 is $P_F$ for first domain 14*a* and $P_F*P_E/2$ for second domain 14*b*, as shown below in Table 7.

TABLE 7

| Domains Resulting From Use of Specific Polyhedra When Using the Vertex to Vertex Method | | | | |
|---|---|---|---|---|
| Type of Polyhedron | Number of Faces, $P_F$ | Number of First Domains 14a | Number of Edges per Face, $P_E$ | Number of Second Domains 14b |
| Tetrahedron | 4 | 4 | 3 | 6 |
| Cube | 6 | 6 | 4 | 12 |
| Octahedron | 8 | 8 | 3 | 12 |
| Dodecahedron | 12 | 12 | 5 | 30 |
| Icosahedron | 20 | 20 | 3 | 30 |

While the six methods previously described each make use of two control points, it is possible to create irregular domains based on more than two control points. For example, three, or even more, control points may be used. The use of additional control points allows for potentially different shapes for irregular domains. An exemplary method using a midpoint M, a center C and a vertex V as three control points for creating one irregular domain is described below.

The Midpoint to Center to Vertex Method

Figure 8A:
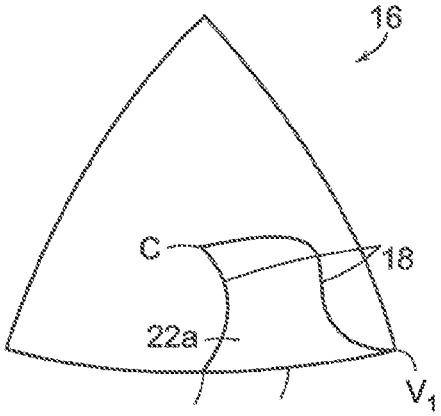
FIG. 8A illustrates a first element of the present invention in a polyhedron face.
Figure 8D:
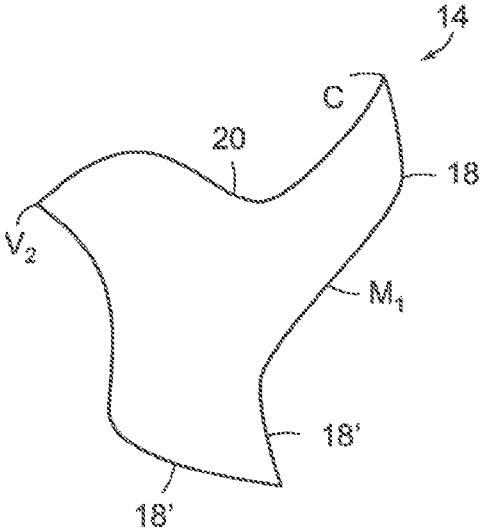
FIG. 8D illustrates a single domain of the present invention based on the two domains of FIG. 8C.
Figure 8B:
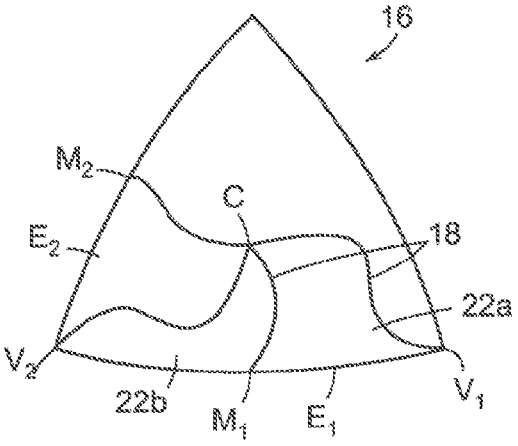
FIG. 8B illustrates a first and a second element of the present invention in the polyhedron face of FIG. 8A.

Referring to FIGS. 8A-8E, the midpoint to center to vertex method yields one domain that tessellates to cover the surface of golf ball 10. The domain is defined as follows:

1. A regular polyhedron is chosen (FIGS. 8A-8E use an icosahedron);
2. A single face 16 of the regular polyhedron is chosen, as shown in FIG. 8A;
3. A midpoint $M_1$ on edge $E_1$ of face 16, Center C of face 16 and a vertex $V_1$ on edge $E_1$ are connected with a segment 18, and segment 18 and the portion of edge $E_1$ between midpoint $M_1$ and vertex $V_1$ define a first element 22*a*, as shown in FIG. 8A;
4. A copy 20 of segment 18 is rotated about center C, such that copy 20 connects center C with a midpoint $M_2$ on edge $E_2$ adjacent to edge $E_1$, and connects center C with a vertex $V_2$ at the intersection of edges $E_1$ and $E_2$, and the portion of segment 18 between midpoint $M_1$ and center C, the portion of copy 20 between vertex $V_2$ and center C, and the portion of edge $E_1$ between midpoint $M_1$ and vertex $V_2$ define a second element 22*b*, as shown in FIG. 8B;
5. First element 22*a* and second element 22*b* are rotated about midpoint $M_1$ of edge $E_1$, as seen in FIG. 8C, to define two domains 14, wherein a single domain 14 is bounded solely by portions of segment 18 and copy 20 and the rotation 18' of segment 18, as seen in FIG. 8D.

Figure 8E:
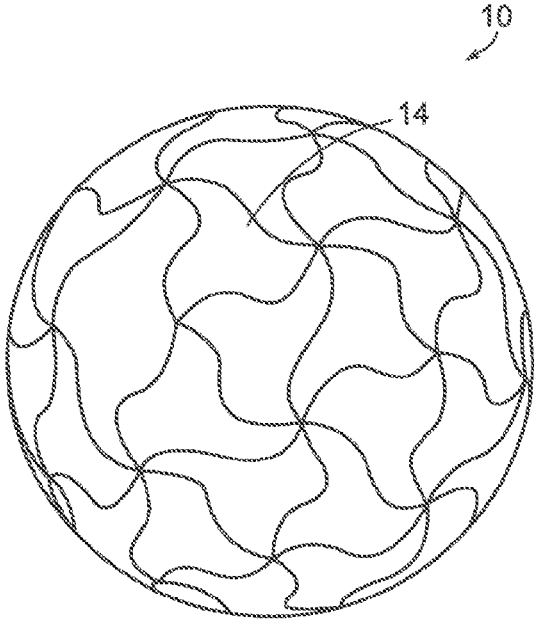
FIG. 8E illustrates a golf ball formed using a method of the present invention formed of the domains of FIG. 8D.
Figure 8C:
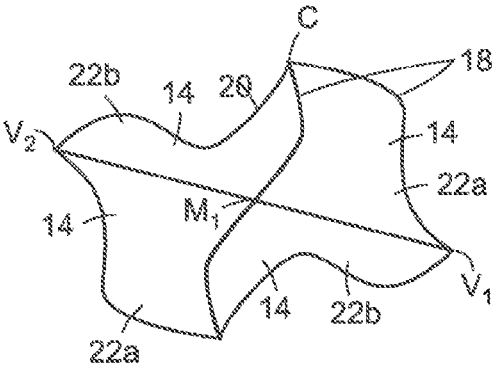
FIG. 8C illustrates two domains of the present invention composed of first and second elements of FIG. 8B.

When domain 14 is tessellated to cover the surface of golf ball 10, as shown in FIG. 8E, a different number of total domains 14 will result depending on the regular polyhedron chosen as the basis for control points M, C, and V. The number of domains 14 used to cover the surface of golf ball 10 is equal to the number of faces $P_F$ of the polyhedron chosen times the number of edges $P_E$ per face of the polyhedron, as shown below in Table 8.

TABLE 8

| Domains Resulting From Use of Specific Polyhedra When Using the Midpoint to Center to Vertex Method | | | |
|---|---|---|---|
| Type of Polyhedron | Number of Faces, $P_F$ | Number of Edges, $P_E$ | Number of Domains 14 |
| Tetrahedron | 4 | 3 | 12 |
| Cube | 6 | 4 | 24 |
| Octahedron | 8 | 3 | 24 |
| Dodecahedron | 12 | 5 | 60 |
| Icosahedron | 20 | 3 | 60 |

While the methods described previously provide a framework for the use of center C, vertex V, and midpoint M as the only control points, other control points are useable. For example, a control point may be any point P on an edge E of the chosen polyhedron face. When this type of control point is used, additional types of domains may be generated, though the mechanism for creating the irregular domain(s) may be different. An exemplary method, using a center C and a point P on an edge, for creating one such irregular domain is described below.

The Center to Edge Method

Figure 9A:
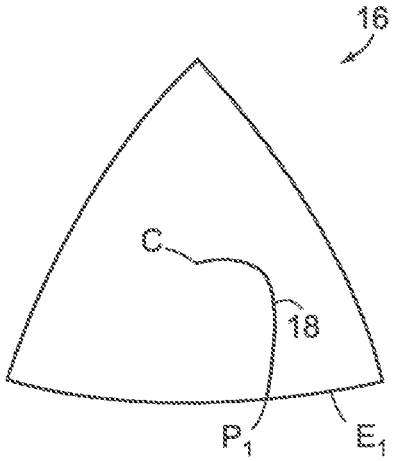
FIG. 9A illustrates a polyhedron face.
Figure 9D:
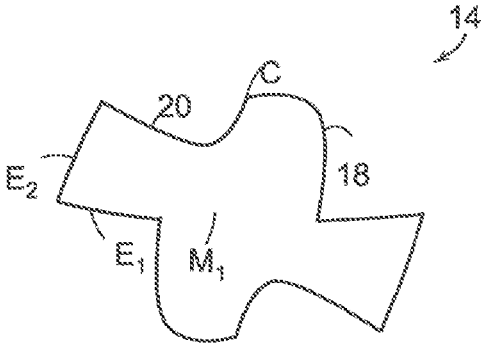
FIG. 9D illustrates a domain formed by the methods of the present invention based on the elements of FIG. 9C.
Figure 9B:
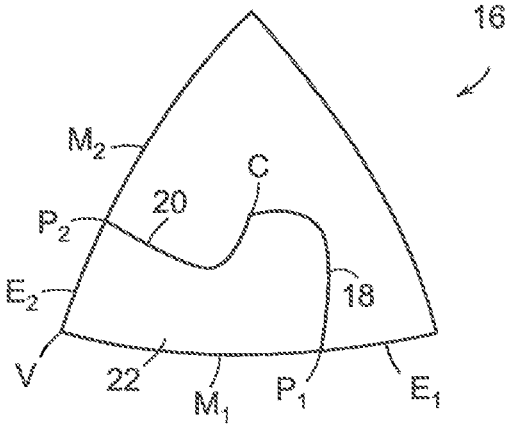
FIG. 9B illustrates an element of the present invention in the polyhedron face of FIG. 9A.

Referring to FIGS. 9A-9E, the center to edge method yields one domain that tessellates to cover the surface of golf ball 10. The domain is defined as follows:

1. A regular polyhedron is chosen (FIGS. 9A-9E use an icosahedron);
2. A single face 16 of the regular polyhedron is chosen, as shown in FIG. 9A;
3. Center C of face 16, and a point $P_1$ on edge $E_1$ are connected with a segment 18;
4. A copy 20 of segment 18 is rotated about center C, such that copy 20 connects center C with a point $P_2$ on edge $E_2$ adjacent to edge $E_1$, where point $P_2$ is positioned identically relative to edge $E_2$ as point $P_1$ is positioned relative to edge $E_1$, such that the two segments 18 and 20 and the portions of edges $E_1$ and $E_2$ between points $P_1$ and $P_2$, respectively, and a vertex V, which connects edges $E_1$ and $E_2$, define an element 22, as shown best in FIG. 9B; and 5. Element 22 is rotated about midpoint $M_1$ of edge $E_1$ or midpoint $M_2$ of edge $E_2$, whichever is located within element 22, as seen in FIGS. 9B-9C, to create a domain 14, as seen in FIG. 9D.

Figure 9E:
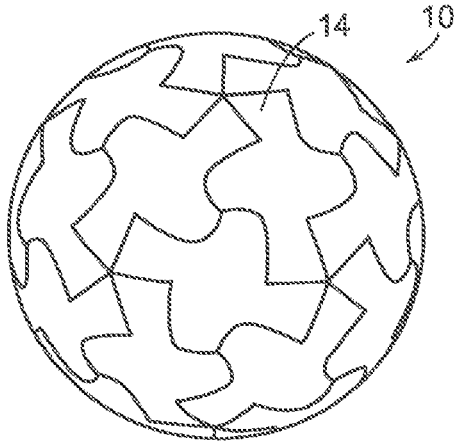
FIG. 9E illustrates a golf ball formed using a method of the present invention formed of domains of FIG. 9D.
Figure 9C:
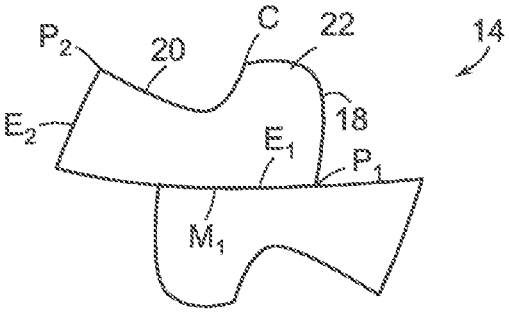
FIG. 9C illustrates two elements of FIG. 9B combining to form a domain of the present invention.

When domain 14 is tessellated to cover the surface of golf ball 10, as shown in FIG. 9E, a different number of total domains 14 will result depending on the regular polyhedron chosen as the basis for control points C and $P_1$. The number of domains 14 used to cover the surface of golf ball 10 is equal to the number of faces $P_F$ of the polyhedron chosen times the number of edges $P_E$ per face of the polyhedron divided by 2, as shown below in Table 9.

TABLE 9

Domains Resulting From Use of Specific Polyhedra When Using the Center to Edge Method

| Type of Polyhedron | Number of Faces, $P_F$ | Number of Edges, $P_E$ | Number of Domains 14 |
|---|---|---|---|
| Tetrahedron | 4 | 3 | 6 |
| Cube | 6 | 4 | 12 |
| Octahedron | 8 | 3 | 12 |
| Dodecahedron | 12 | 5 | 30 |
| Icosahedron | 20 | 3 | 30 |

Though each of the above described methods has been explained with reference to regular polyhedrons, they may also be used with certain non-regular polyhedrons, such as Archimedean Solids, Catalan Solids, or others. The methods used to derive the irregular domains will generally require some modification in order to account for the non-regular face shapes of the non-regular solids. An exemplary method for use with a Catalan Solid, specifically a rhombic dodecahedron, is described below.

A Vertex to Vertex Method for a Rhombic Dodecahedron

Figure 10A:
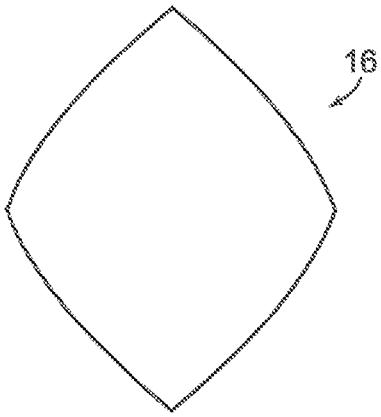
FIG. 10A illustrates a face of a rhombic dodecahedron.
Figure 10B:
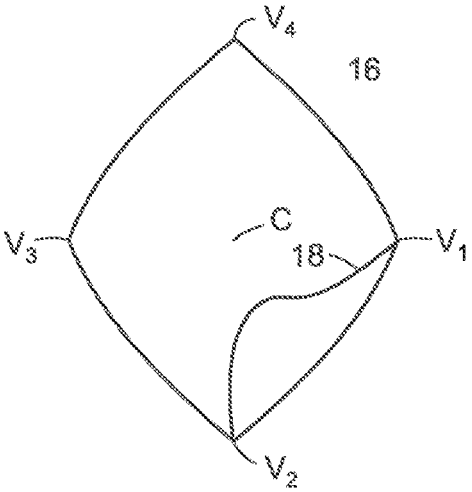
FIG. 10B illustrates a segment of the present invention in the face of FIG. 10A.
Figure 10C:
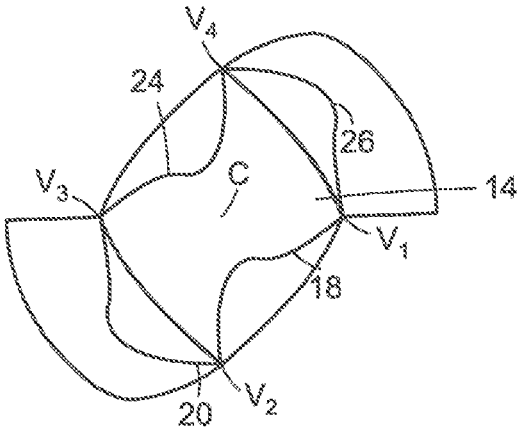
FIG. 10C illustrates the segment of FIG. 10B and copies thereof forming a domain of the present invention.
Figure 10D:
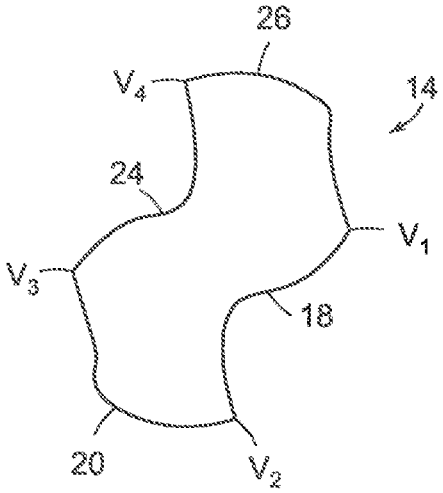
FIG. 10D illustrates a domain formed by a method of the present invention based on the segments of FIG. 10C.
Figure 10E:
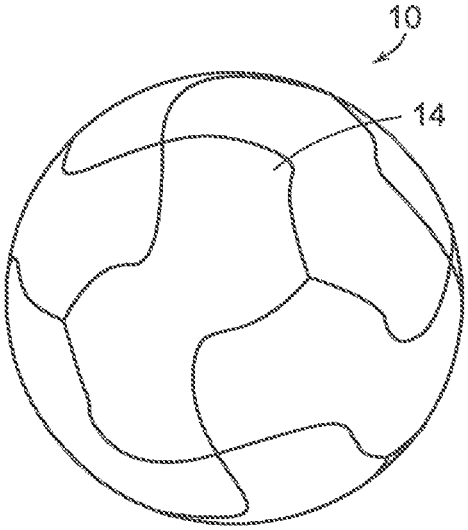
FIG. 10E illustrates a golf ball formed by a method of the present invention formed of domains of FIG. 10D.

Referring to FIGS. 10A-10E, a vertex to vertex method based on a rhombic dodecahedron yields one domain that tessellates to cover the surface of golf ball 10. The domain is defined as follows:

1. A single face 16 of the rhombic dodecahedron is chosen, as shown in FIG. 10A;
2. A first vertex $V_1$ face 16, and a second vertex $V_2$ adjacent to first vertex $V_1$ are connected with a segment 18, as shown in FIG. 10B;
3. A first copy 20 of segment 18 is rotated about vertex $V_2$, such that it connects vertex $V_2$ to vertex V3 of face 16, a second copy 24 of segment 18 is rotated about center C, such that it connects vertex $V_3$ and vertex $V_4$ of face 16, and a third copy 26 of segment 18 is rotated about vertex $V_1$ such that it connects vertex $V_1$ to vertex $V_4$, all as shown in FIG. 10C, to form a domain 14, as shown in FIG. 10D;

When domain 14 is tessellated to cover the surface of golf ball 10, as shown in FIG. 10E, twelve domains will be used to cover the surface of golf ball 10, one for each face of the rhombic dodecahedron.

Figure 11E:
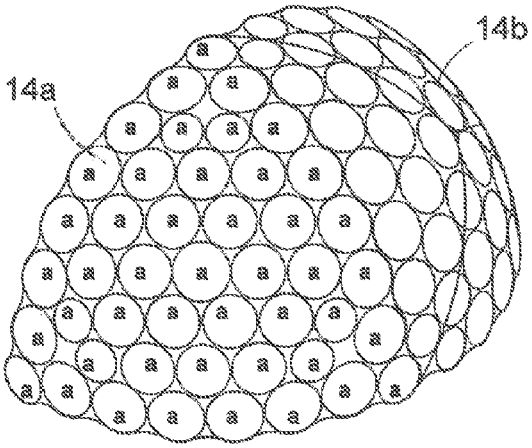
FIG. 11E illustrates a portion of a golf ball formed using a method of the present invention.
Figure 11F:
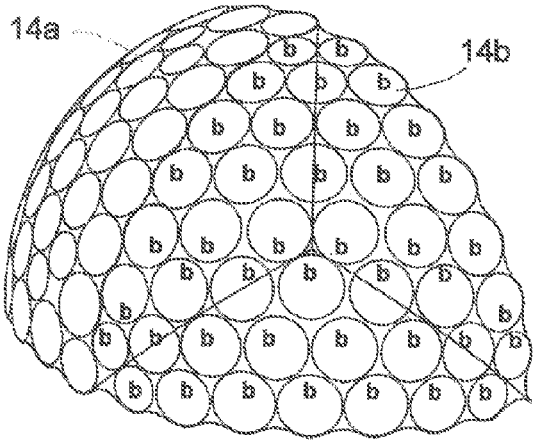
FIG. 11F illustrates another portion of a golf ball formed using a method of the present invention.
Figure 11G:
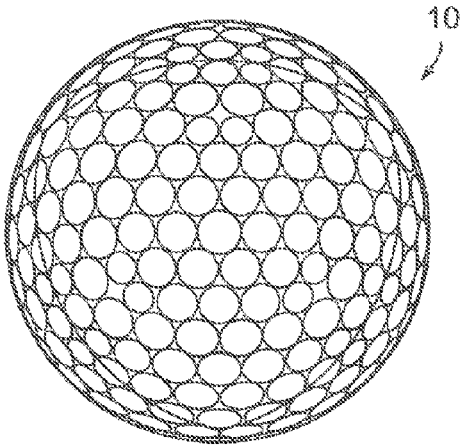
FIG. 11G illustrates a golf ball formed using a method of the present invention.

After the irregular domain(s) are created using any of the above methods, the domain(s) may be packed with dimples in order to be usable in creating golf ball 10. In FIGS. 11E-11G, a first domain and a second domain are created using the midpoint to midpoint method based on a tetrahedron. FIG. 11E shows a first domain 14*a* and a portion of a second domain 14*b* packed with dimples, with the dimples of the first domain 14*a* designated by the letter a. FIG. 11F shows a second domain 14*b* and a portion of a first domain 14*a* packed with dimples, with the dimples of the second domain 14*b* designated by the letter b. FIG. 11G shows a first domain 14*a* and a second domain 14*b* packed with dimples and tessellated to cover the surface of golf ball 10.

In one embodiment, there are no limitations on how the dimples are packed. In another embodiment, the dimples are packed such that no dimple intersects a line segment.

There are no limitations to the dimple shapes or profiles selected to pack the domains. Though the present invention includes substantially circular dimples in one embodiment, dimples or protrusions (brambles) having any desired characteristics and/or properties may be used. For example, in one embodiment the dimples may have a variety of shapes and sizes including different depths and perimeters. In particular, the dimples may be concave hemispheres, or they may be triangular, square, hexagonal, catenary, polygonal or any other shape known to those skilled in the art. They may also have straight, curved, or sloped edges or sides. To summarize, any type of dimple or protrusion (bramble) known to those skilled in the art may be used with the present invention. The dimples may all fit within each domain, as seen in FIGS. 1A, 1D, and 11E-11G, or dimples may be shared between one or more domains, as seen in FIGS. 3C-3D, so long as the dimple arrangement on each independent domain remains consistent across all copies of that domain on the surface of a particular golf ball. Alternatively, the tessellation can create a pattern that covers more than about 60%, preferably more than about 70% and preferably more than about 80% of the golf ball surface without using dimples.

In other embodiments, the domains may not be packed with dimples, and the borders of the irregular domains may instead comprise ridges or channels. In golf balls having this type of irregular domain, the one or more domains or sets of domains preferably overlap to increase surface coverage of the channels. Alternatively, the borders of the irregular domains may comprise ridges or channels and the domains are packed with dimples.

When the domain(s) is patterned onto the surface of a golf ball, the arrangement of the domains dictated by their shape and the underlying polyhedron ensures that the resulting golf ball has a high order of symmetry, equaling or exceeding 12. The order of symmetry of a golf ball produced using the method of the current invention will depend on the regular or non-regular polygon on which the irregular domain is based. The order and type of symmetry for golf balls produced based on the five regular polyhedra are listed below in Table 10.

TABLE 10

Symmetry of Golf Ball of the Present Invention as a Function of Polyhedron

| Type of Polyhedron | Type of Symmetry | Symmetrical Order |
|---|---|---|
| Tetrahedron | Chiral Tetrahedral Symmetry | 12 |
| Cube | Chiral Octahedral Symmetry | 24 |
| Octahedron | Chiral Octahedral Symmetry | 24 |
| Dodecahedron | Chiral Icosahedral Symmetry | 60 |
| Icosahedron | Chiral Icosahedral Symmetry | 60 |

These high orders of symmetry have several benefits, including more even dimple distribution, the potential for higher packing efficiency, and improved means to mask the ball parting line. Further, dimple patterns generated in this manner may have improved flight stability and symmetry as a result of the higher degrees of symmetry.

In other embodiments, the irregular domains do not completely cover the surface of the ball, and there are open spaces between domains that may or may not be filled with dimples. This allows dissymmetry to be incorporated into the ball.

Dimple patterns of the present invention are particularly suitable for packing dimples on seamless golf balls. Seamless golf balls and methods of producing such are further disclosed, for example, in U.S. Pat. Nos. 6,849,007 and 7,422,529, the entire disclosures of which are hereby incorporated herein by reference.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having an outer surface comprising a plurality of dimples disposed thereon, wherein the dimples are arranged in multiple copies of a first domain, wherein the first domain has rotational three-way symmetry about the central point of the first domain, wherein the first domain is tessellated to cover the outer surface of the golf ball in a uniform pattern and wherein the pattern consists of four, six, eight, twelve or twenty first domains, and wherein the outer surface does not contain any great circles.

2. The golf ball of claim 1, wherein the outer surface of the golf ball comprises 352 dimples.

3. The golf ball of claim 1, wherein the outer surface of the golf ball comprises 328 dimples.

4. The golf ball of claim 1, wherein the outer surface of the golf ball comprises 312 dimples.

5. The golf ball of claim 1, wherein the outer surface of the golf ball comprises 340 dimples.

6. The golf ball of claim 1, wherein the outer surface of the golf ball comprises 364 dimples.

7. The golf ball of claim 1, wherein the outer surface of the golf ball comprises 376 dimples.

* * * * *